US006129250A

United States Patent [19]

Cho

[11] Patent Number: 6,129,250

[45] Date of Patent: Oct. 10, 2000

[54] DEVICE AND METHOD OF SHAPING THE VISORS OF CAPS

[75] Inventor: Byoung-Woo Cho, Seoul, Rep. of Korea

[73] Assignee: Yupoong & Co., Ltd., Seoul, Rep. of Korea

[21] Appl. No.: 09/450,984

[22] Filed: Nov. 29, 1999

Related U.S. Application Data

[62] Division of application No. 09/266,281, Mar. 11, 1999.

[30] Foreign Application Priority Data

Apr. 7, 1998 [KR] Rep. of Korea ..... 98-5335

[51] Int. Cl.[7] ..... A42C 1/04

[52] U.S. Cl. ..... 223/12; 223/13; 223/26; 223/52

[58] Field of Search ..... 223/12, 13, 17, 223/24, 26, 25, 52; 425/398, 412, 416; 264/324

[56] References Cited

U.S. PATENT DOCUMENTS

| | | | |
|---|---|---|---|
| 926,343 | 6/1909 | Mackey | 223/12 |
| 2,087,798 | 7/1937 | Cuming | 223/12 |
| 2,455,257 | 11/1948 | Kohler et al. | 223/12 |
| 3,199,752 | 8/1965 | Casse | 223/12 |
| 4,157,151 | 6/1979 | Sanko | 223/13 |
| 5,732,858 | 3/1998 | Plastino | 223/12 |

*Primary Examiner*—Bibhu Mohanty
*Attorney, Agent, or Firm*—Harrison & Egbert

[57] ABSTRACT

A device and method of shaping the visors of caps is disclosed. In the device, a visor shaping unit has a movable upper mold and a fixed lower mold. The upper mold, with a coil heater, is outwardly curved into a predetermined curvature at its lower surface and is operated by a hydraulic cylinder. The lower mold is inwardly curved into the same curvature as that of the upper mold at the top surface. The cooling unit has first to third chambers with a plurality of perforated sections being formed on the top wall of each of the chambers. Upper and lower panels are exteriorly attached to the top wall of each chamber at a position covering each perforated section. The two panels define a curved gap between them, thus holding a heated visor in the gap during a cooling process. The visors are heated at about 90° C. to 150 ° C. for about 5–20 seconds in the visor shaping unit prior to being cooled in the cooling unit for about 10–30 seconds using cool air having a temperature of about 5–20 ° C. The curved configuration of the visors, shaped by the device and method of this invention, is maintained almost permanently.

1 Claim, 5 Drawing Sheets

DEVICE AND METHOD OF SHAPING THE VISORS OF CAPS

RELATED APPLICATIONS

The present application is a divisional application of U.S. patent application Ser. No. 09/266,281, filed on Mar. 11, 1999, and entitled "DEVICE AND METHOD OF SHAPING THE VISORS OF CAPS", presently pending.

BACKGROUND OF THE INVENTION

1. Field of the Invention

The present invention relates, in general, to a device and method of shaping the visors of caps and, more particularly, to a device and method of heating and cooling such a visor while curving the visor into a predetermined curvature, thus allowing a curved configuration of the visor to be maintained almost permanently.

2. Description of the Prior Art

As well known to those skilled in the art, a cap is a soft, light hat, which has a curved visor protruding at the front and is worn on the head, thus giving protection from rain, snow and strong light from the sun. Several types of caps, classified in accordance with their use, are known. Some people use such caps as accessories for decorative purpose or showing one's marked individuality.

As shown in FIG. 1, a typical cap 1 is comprised of a dome-shaped crown 2, which is made of natural or synthetic fiber cloth. A stiff visor 4, which is formed into a predetermined shape using a hard synthetic resin, protrudes at the front of the crown 2.

Such a visor 4 is typically and closely covered with cloth prior to being sewn to the front of the crown 2. When the above cap 1 is worn on the head, the visor 4 is manually shaped into a curvature by a user, thus allowing the cap 1 to closely fit to the head and give protection from strong light from sun, and showing the user's marked individuality.

However, such a stiff visor is made of a hard synthetic resin, thus being problematic in that it is not easy to shape the visor into a desired curvature and to maintain the desired curvature. That is, the stiff visor easily restores its original flat shape due to elasticity of its hard synthetic resin material and requires repeatedly shaping into the desired curvature, thereby being inconvenient to users.

SUMMARY OF THE INVENTION

Accordingly, the present invention has been made keeping in mind the above problems occurring in the prior art, and an object of the present invention is to provide a device and method of shaping the visors of caps, which shapes the visor of a cap into a predetermined curvature by heating and cooling the visor while curving the visor, thus allowing the curved configuration of the visor to be maintained almost permanently.

In an aspect, the present invention provides a device for shaping the visors of caps, comprising: a visor shaping unit having a base frame having both a support floor and a support roof, the base frame also having a controller, a temperature/time setting unit and a start switch; a plurality of sets of molds regularly arranged on the base frame and adapted for heating and shaping the visors into a desired curvature, each of the sets of molds having a hydraulic cylinder having a retractable piston rod, the cylinder being vertically mounted to the support roof of the base frame using an upper bracket, with the piston rod being vertically directed toward the support floor of the base frame; a movable upper mold outwardly curved into the desired curvature at a lower surface thereof, the upper mold being mounted to a lower end of the piston rod of the hydraulic cylinder, thus being movable along with the piston rod under the control of the controller; a coil heater set in the upper mold and adapted for heating the upper mold to a predetermined temperature; a temperature sensor set in a recess formed on a front portion of the upper mold and adapted for sensing a temperature of the upper mold; a lower mold inwardly curved into the same curvature as that of the upper mold at a top surface thereof, the lower mold being mounted to the support floor of the base frame using a lower bracket; and a clamp member attached to the top surface of the lower mold while being curved into the same curvature as that of the top surface of the lower mold; and a cooling unit having first to third chambers at an upper portion thereof, the first to third chambers being positioned in a stepped arrangement and individually having a plurality of perforated sections at a top wall thereof, the cooling unit also having: a set of curved panels exteriorly attached to the top wall of each of the chambers at a position covering each of the perforated sections, the set of curved panels having a perforated upper panel and a perforated lower panel with a curved gap being defined between the two perforated panels; and a cool air fan connected to the first to third chambers through first to third air pipes and adapted for supplying pressurized cool air into the first to third chambers.

In another aspect, the present invention provides a method of shaping the visors of caps, comprising the steps of: heating the visors at a temperature of about 90° C. to 150° C. for about 5–20 seconds while compressing each of the visors using a set of molds of a visor shaping unit, the set of molds being curved into a predetermined curvature at their facing surfaces; and cooling the heated visors in a cooling unit for about 10–30 seconds using cool air having a temperature of about 5–20° C., thus setting the curved configuration of the visors.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

The visor shaping device according to the preferred embodiment of this invention generally comprises two units: a visor shaping unit and a cooling unit.

Figure 1:
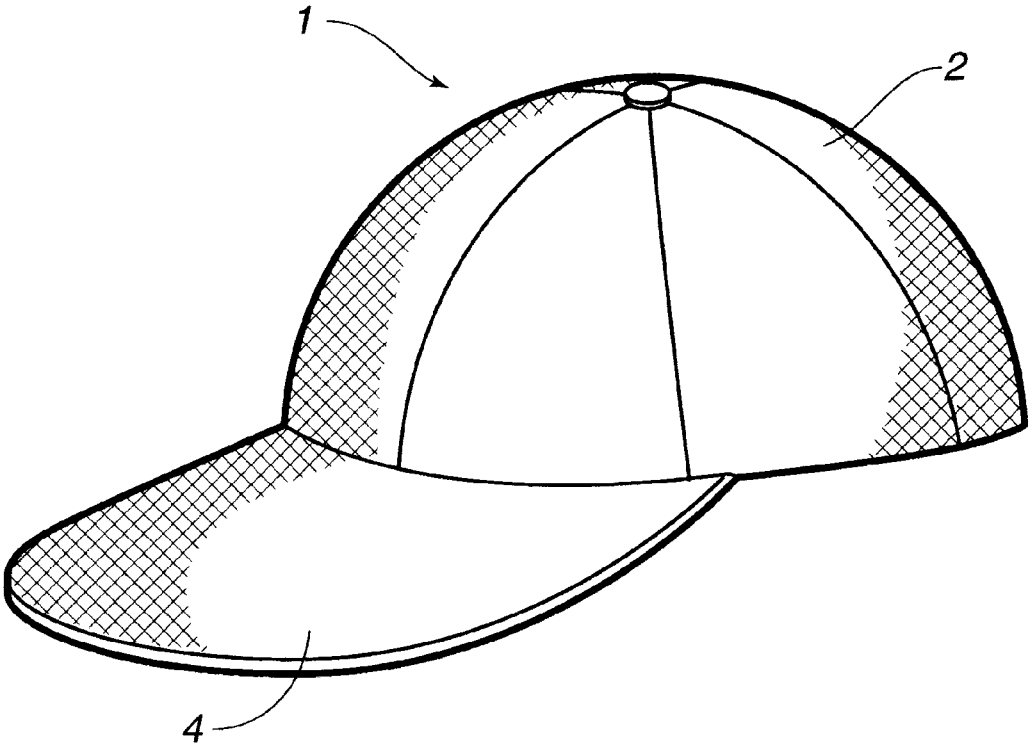
FIG. 1 is a perspective view showing the construction and configuration of a typical cap.
Figure 2:
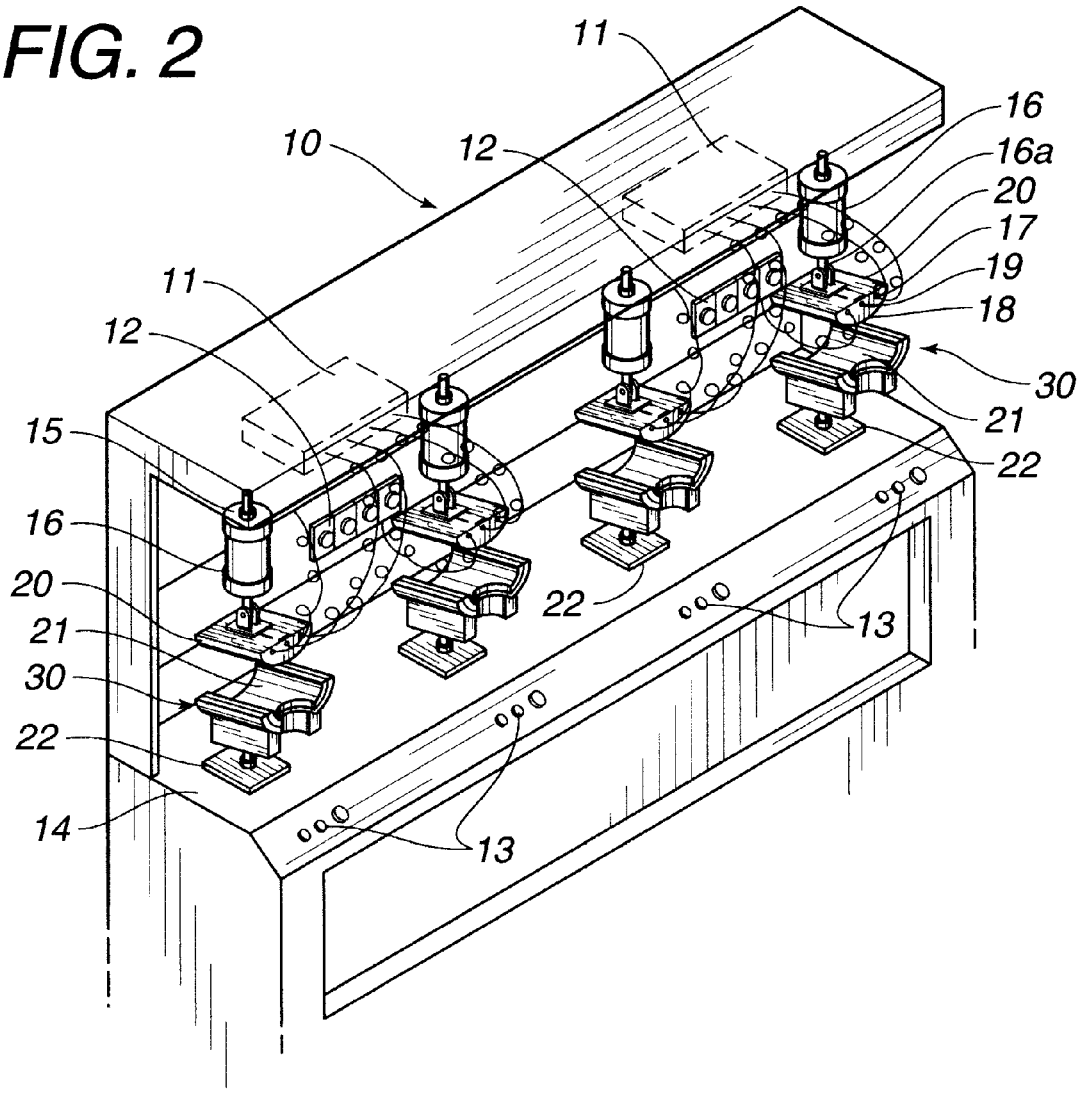
FIG. 2 is a perspective view of a visor shaping unit included in the device in accordance with the preferred embodiment of the present invention.
Figure 3:
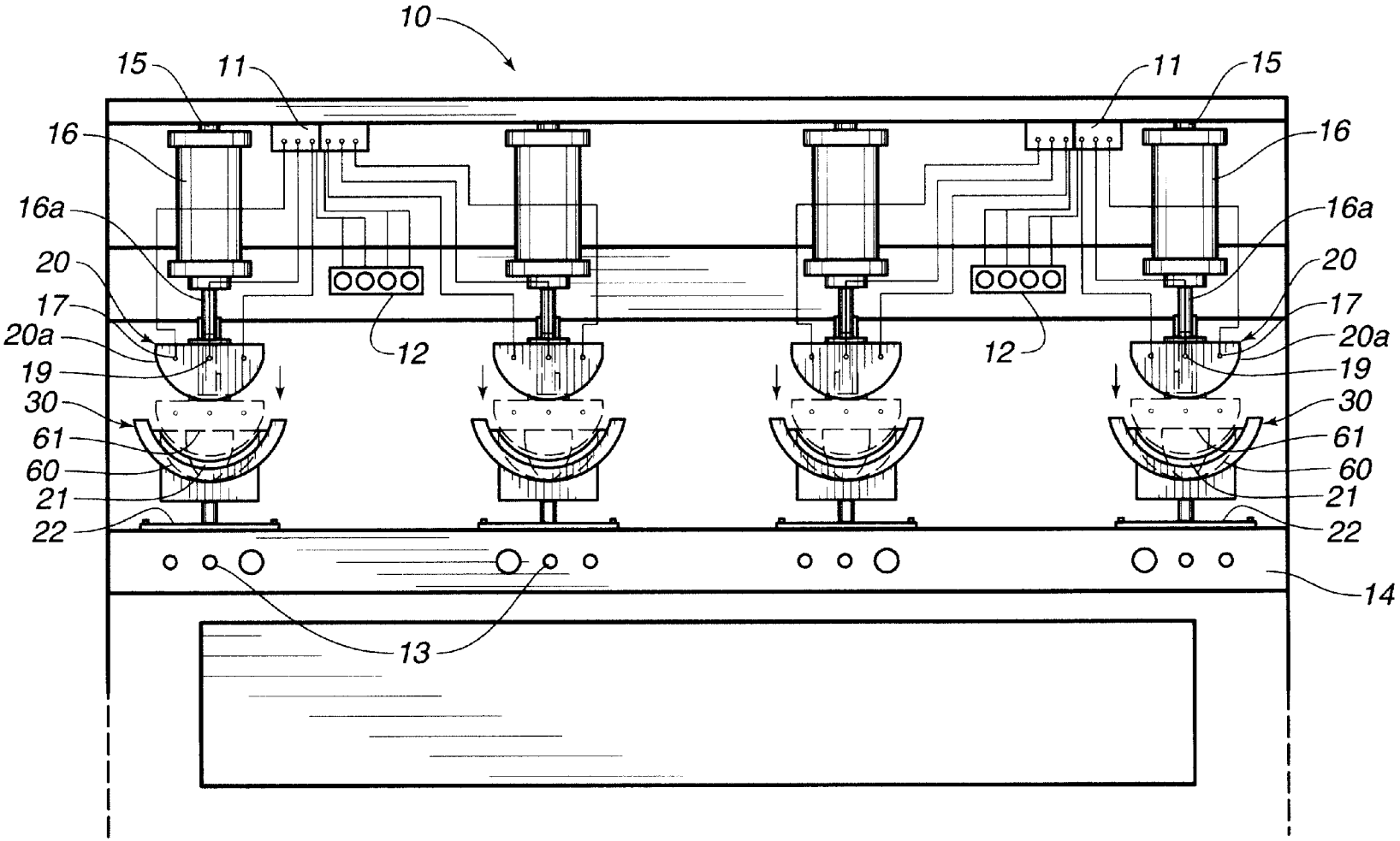
FIG. 3 is a front view, showing the operation of the visor shaping unit of this invention.

FIGS. 2 and 3 show the construction and operation of the visor shaping unit included in the device of this invention. As shown in the drawings, the visor shaping unit 10 comprises a base frame 14 with both a support floor and a support roof. The base frame 14 is provided with two controllers 11, two temperature/time setting panels 12 and a plurality of start switches 13. The above shaping unit 10 also carries a plurality of sets of molds, which are regularly arranged on the base frame 14 and individually comprise one movable mold 20 and one fixed lower mold 30. The above upper mold 20, outwardly curved into a predetermined curvature at the lower surface thereof, is fixedly mounted to a piston rod 16*a* of a hydraulic cylinder 16. The above cylinder 16 is mounted to the support roof of the base frame 14 using an upper bracket 15 while being vertically directed toward the support floor of the base frame 14. A coil heater 17 is set in the upper mold 20, while a temperature sensor 19 is set in a recess 18 formed at the front portion of the upper mold 20. The lower mold 30, of which the top surface is inwardly curved into the same curvature as that of the upper mold 20 so as to substantially meet the curved lower surface of the upper mold 20, is fixedly mounted to the support floor of the base frame 14 using a lower bracket 22. A clamp member 21 is attached to the curved top surface of the lower mold 30 while being curved into the same curvature as that of the top surface.

The above clamp member 21 is made of a synthetic resin material, having high thermal resistance and high flexibility. The operational conditions, or the heating temperature and the heating time, of each of the upper molds 20 are respectively preset to about 90–150° C. and about 5–20 seconds by an associated temperature/time setting panel 12.

Figure 4:
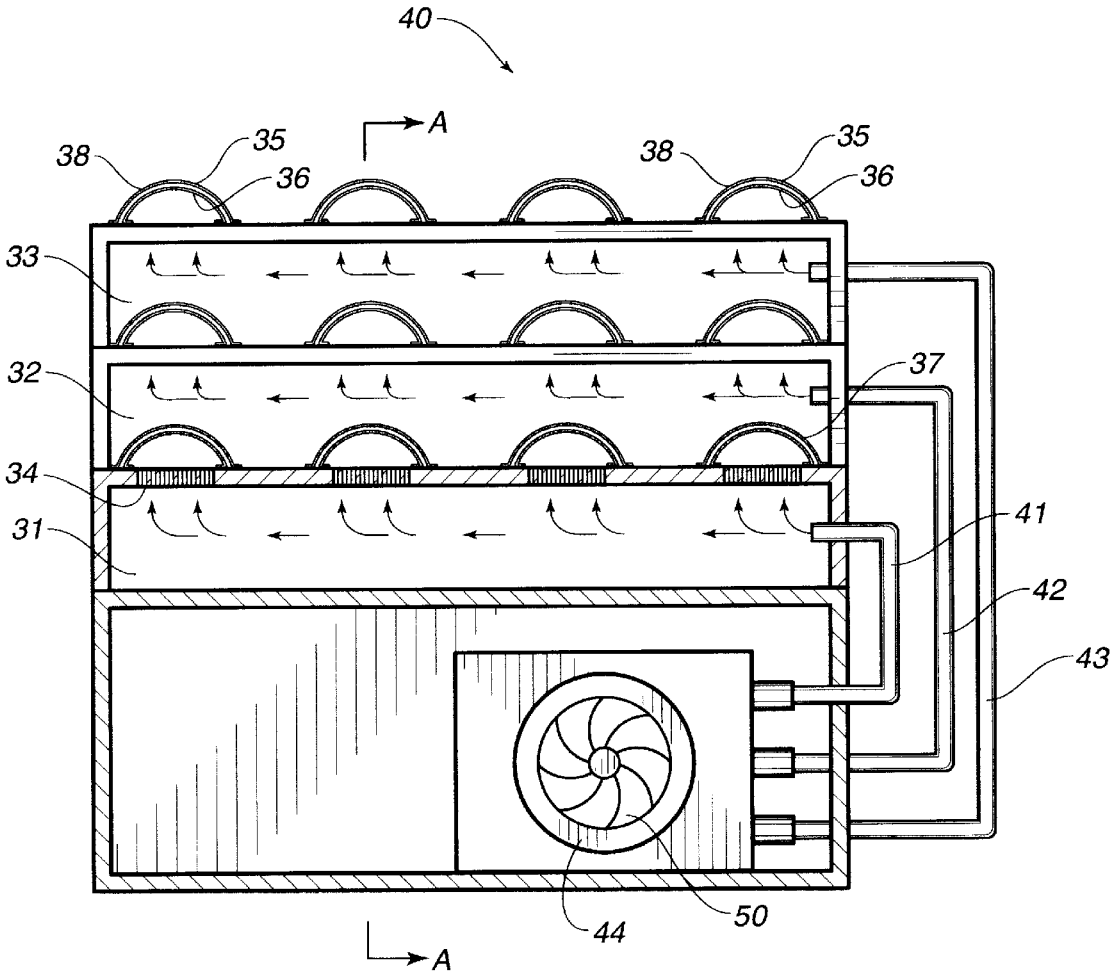
FIG. 4 is a partially-sectioned front view of a cooling unit included in the visor shaping device of this invention.
Figure 5:
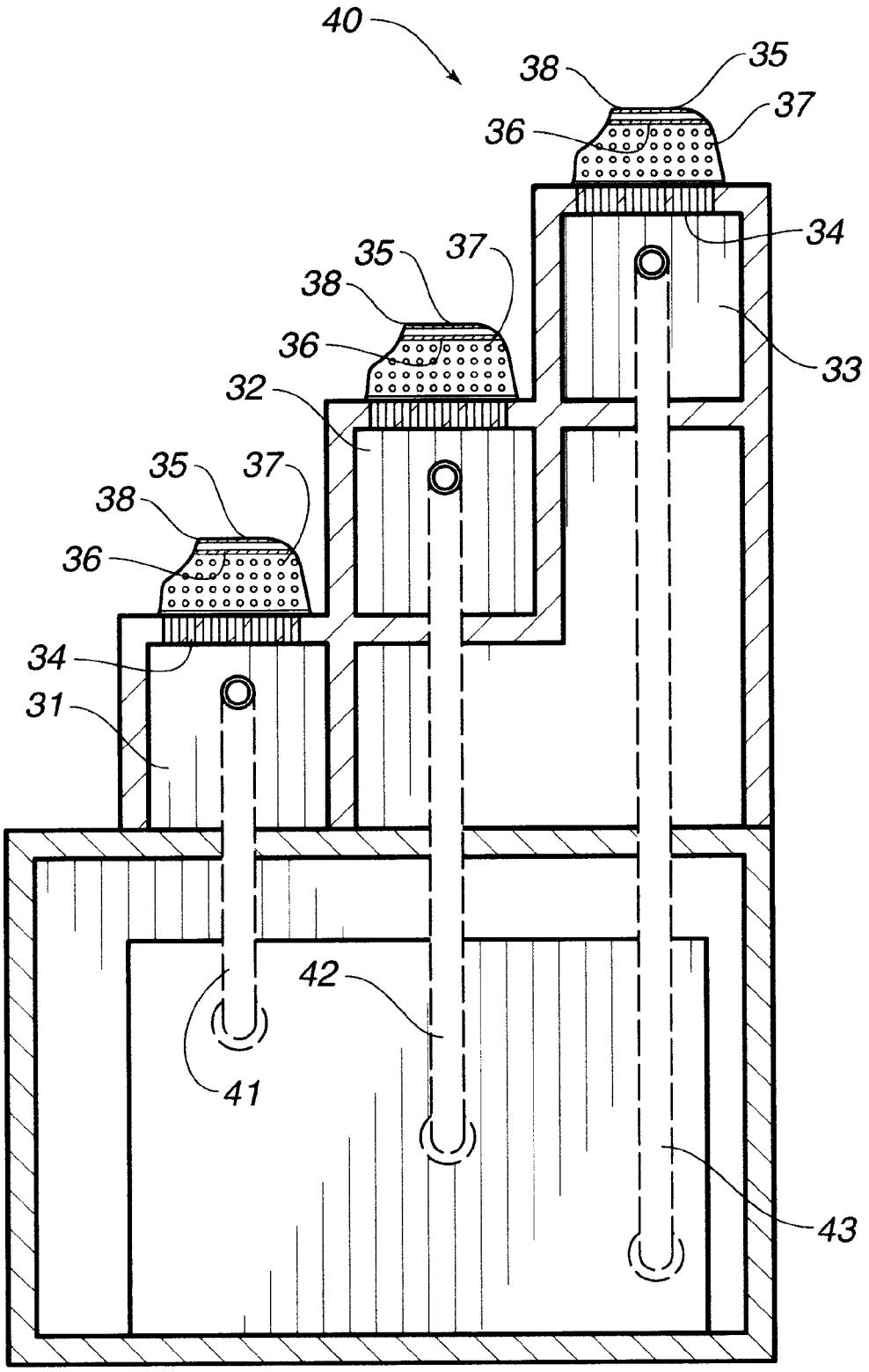
FIG. 5 is a sectional view of the above cooling unit taken along the line A—A of FIG. 4.

FIGS. 4 and 5 show a cooling unit included in the visor shaping device of this invention. As shown in the drawings, the cooling unit 40 has a multi-staged structure with three-stepped chambers: first to third chambers 31, 32 and 33. The top wall of each of the chambers 31, 32 and 33 has a plurality of perforated sections 34 at regularly spaced positions. Each of the perforated sections 34 includes a plurality of rows of perforations. The perforations of each section 34 are spaced out at regular intervals. A set of curved panels are provided on the top wall of each of the chambers 31, 32 and 33 at a position covering each of the perforated sections 34 of the top wall. The set of curved panels comprise one upper panel 35 and one lower panel 36 with a curved gap 38 being defined between the two panels 35 and 36. The two panels 35 and 36 are also regularly perforated, thus forming a plurality of air holes 37. In the operation of the cooling unit 40, pressurized cool air is introduced from a motorized-cooling fan 50 into the three chambers 31, 32 and 33 through first to third air pipes 41, 42 and 43. In such a case, the first to third pipes 41, 42 and 43 extend from the fan 50 to the first to third chambers 31, 32 and 33, respectively.

In the drawings, the reference numeral 20*a* denotes a thermal protector layer formed on the curved lower surface of each upper mold 20, the numeral 44 denotes a drive motor for the fan 50, the numeral 60 denotes a cap, and the numeral 61 denotes the visor of the cap 60.

The operational effect of the above visor shaping device will be described hereinbelow.

As shown in FIGS. 2 to 5, it is possible to shape the visors 61 of caps 60 into a desired curvature using the device of this invention. In order to shape the visors 61 into a curvature, a plurality of caps 60 are primarily positioned around the lower molds 30 with the visors 61 of the caps 60 being clamped on the lower molds 30. In such a case, the visors 61 are firmly clamped on the lower molds 30 using the curved clamp members 21. It is necessary to curve the visors 61 prior to clamping the visors 61 using the clamp members 21.

Thereafter, the start switches 13 of the base frame 14 are operated, thus starting both the heaters 17 and the hydraulic cylinders 16 under the control of the controllers 11. In such a case, the heating temperature of each of the heaters 17 for the upper molds 20 ranges from about 90° C. to about 150° C. Such a heating temperature of each heater 17 is maintained during an operation of the shaping unit 10 under the control of the temperature sensors 19 of the upper molds After the curved visors 61 are clamped on the lower molds 30 with the upper molds 20 being completely heated by the heaters 17, the controllers 11 output control signals to the hydraulic cylinders 16, thus allowing the piston rods 16*a* to vertically extend from the cylinders 16 to a length. The heated upper molds 20, fixed to the lower ends of the piston rods 16*a*, thus compress and heat the curved visors 61 clamped on the lower molds 30.

In such a case, the upper molds 20 heat the visors 61 for about 5–20 seconds. The above heating time for the visors 61 is automatically controlled by the controllers 11. That is, the controllers 11 may change the heating time for the visors 61 in accordance with thickness and/or material of the visors 61. In the present invention, the thermal protector layer 20*a*, covering each of the upper molds 20, is preferably made of cotton.

After the visors 61 are completely heated by the upper molds 20, each controller 11 outputs another control signal to associated hydraulic cylinders 16 so as to allow the piston rods 16*a* of the cylinders 16 to be retracted to their original positions.

Thereafter, the caps 60, with the completely heated visors 61, are removed from the lower molds 30 and are moved to the cooling unit 40. In the cooling unit 40, each of the visors 61 is inserted into the gap 38 between the upper and lower panels 35 and 36, thus allowing the curvature of each heated visor 61 to be maintained in the cooling unit 40. After setting the visors 61 in the sets of panels, the cooling unit 40 is started, thus supplying cool air from the fan 50 into the first to third chambers 31, 32 and 33 through the first to third pipes 41, 42 and 43. In the first to third chambers 31, 32 and 33, cool air passes upwardly through the perforated sections 34 of the top walls prior to being introduced to the lower panels 36, thus gradually cooling the hot visors 61.

In such a case, the temperature of cool air used for cooling the visors 61 in the three chambers 31, 32 and 33 ranges from about 5° C. to about 25° C., while the cooling time for the visors 61 ranges from about 10 seconds to about 30 seconds. The hot and soft visors 61, held in the curved gaps 38 between the upper and lower panels 35 and 36, are gradually cooled by cool air. When the visors 61 are completely cooled, the curvature of the visors 61 is maintained almost permanently since the heated visors 61 are hardened while being somewhat shrunk at heated portions thereof. Therefore, the curvature of the visors 61 is stably maintained even when the visors 61 are removed from the upper and lower panels 35 and 36 after the visors 61 are completely cooled. It is thus not necessary for users to repeatedly shape the visors 61 into the desired curvature. The visors 61 are convenient to users who want to wear caps with curved visors.

When the cloth, covering each of the visors, is made of a thermal sensitive material, such as nylon, natural leather, polyurethane leather, rubbered material, waxed material, or vinyl, the covering cloth of the visor may be undesirably and thermally deformed or damaged during a heating process of the visor shaping unit. In order to overcome the above problem, naked visors free from such a thermal sensitive cloth may be heated and cooled in the device. After completely shaping the naked visors through the heating and cooling processes, each of the visors is covered with such a thermal sensitive cloth.

As described above, the present invention provides a device and method of shaping the visors of caps. The device and method of this invention shapes the visor of a cap into a predetermined curvature by heating and cooling the visor while curving the visor, thus allowing the curved configuration of the visor to be maintained almost permanently. It is thus not necessary for a user to repeatedly shape the visor into a desired curvature. The visors, shaped by the device and method of this invention, are convenient to users who want to wear caps with curved visors as accessories for decorative purposes or for one's marked individuality. The device and method of this invention thus improves market competitiveness of caps.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A device for shaping the visors of caps, comprising:

a visor shaping unit comprising:

a base frame having both a support floor and a support roof, said base frame also having a controller, a temperature/time setting unit and a start switch;

a plurality of sets of molds regularly arranged on the base frame and adapted for heating and shaping the visors into a desired curvature, each of the sets of molds comprising:

a hydraulic cylinder having a retractable piston rod, said cylinder being vertically mounted to the support roof of the base frame using an upper bracket, with the piston rod being vertically directed toward the support floor of the base frame;

a movable upper mold outwardly curved into the desired curvature at a lower surface thereof, said upper mold being mounted to a lower end of the piston rod of the hydraulic cylinder, thus being movable along with the piston rod under the control of the controller;

a coil heater set in the upper mold and adapted for heating the upper mold to a predetermined temperature;

a temperature sensor set in a recess formed on a front portion of the upper mold and adapted for sensing a temperature of the upper mold;

a lower mold inwardly curved into the same curvature as that of the upper mold at a top surface thereof, said lower mold being mounted to the support floor of the base frame using a lower bracket; and a clamp member attached to the top surface of the lower mold while being curved into the same curvature as that of said top surface of the lower mold; and a cooling unit having first to third chambers at an upper portion thereof, said first to third chambers being positioned in a stepped arrangement and individually having a plurality of perforated sections at a top wall thereof, said cooling unit comprising:

a set of curved panels exteriorly attached to the top wall of each of the chambers at a position covering each of the perforated sections, the set of curved panels consisting of a perforated upper panel and a perforated lower panel with a curved gap being defined between the two perforated panels; and a cool air fan connected to the first to third chambers through first to third air pipes and adapted for supplying pressurized cool air into the first to third chambers.

* * * * *